US009447984B2

(12) United States Patent
Lin et al.

(10) Patent No.: US 9,447,984 B2
(45) Date of Patent: Sep. 20, 2016

(54) AIR CONDITIONING SYSTEM AND CONTROL PARAMETERS ADJUSTMENT METHOD

(71) Applicant: AUTOMOTIVE RESEARCH & TESTING CENTER, Lugang Chen, Changhua Hsien (TW)

(72) Inventors: Po-Hsu Lin, Changhua Hsien (TW); Yen-Ting Cheng, Changhua Hsien (TW); Hong-Chi Wang, Changhua Hsien (TW)

(73) Assignee: AUTOMOTIVE RESEARCH & TESTING CENTER, Lugang Chen, Changhua Hsien (TW)

( * ) Notice: Subject to any disclaimer, the term of this patent is extended or adjusted under 35 U.S.C. 154(b) by 509 days.

(21) Appl. No.: 14/141,522

(22) Filed: Dec. 27, 2013

(65) Prior Publication Data

US 2015/0184882 A1 Jul. 2, 2015

(51) Int. Cl.
*F24F 11/00* (2006.01)

(52) U.S. Cl.
CPC ..... *F24F 11/006* (2013.01); *F24F 2011/0047* (2013.01); *F24F 2011/0063* (2013.01)

(58) Field of Classification Search
CPC ..... F24F 11/006; F24F 11/0009; F24F 2011/0047; F24F 2011/0063; G01R 21/00
See application file for complete search history.

(56) References Cited

U.S. PATENT DOCUMENTS

2003/0097853 A1* 5/2003 Adaniya ..... B60H 1/3208 62/244
2010/0076608 A1* 3/2010 Nakajima ..... G05B 19/042 700/278
2010/0114550 A1* 5/2010 Fujihara ..... F24F 11/0009 703/13
2011/0130880 A1* 6/2011 Nishino ..... F24F 11/006 700/276
2011/0144807 A1* 6/2011 Buda ..... F25B 49/005 700/275
2012/0239251 A1* 9/2012 Wijaya ..... B60H 1/3205 701/36
2013/0184892 A1* 7/2013 Mohan ..... G05B 15/02 700/297

FOREIGN PATENT DOCUMENTS

CN 202032680 U 11/2011
TW 354823 3/1997

* cited by examiner

*Primary Examiner* — Ben Rifkin
*Assistant Examiner* — Michael J Huntley
(74) *Attorney, Agent, or Firm* — patenttm.us

(57) ABSTRACT

A control parameters adjustment method of an air conditioning system has the following steps: (a) building up a comparison table; (b) determining an objective output power; (c) determining whether there is only one preferred operation point by searching the comparison table; (d) when there is only one preferred operation point, adjusting the control parameters based on the preferred operation point; (e) when there are a plurality of preferred operation points, executing a retrieval procedure for selecting one of the preferred operation points, and adjusting the control parameters based on the selected preferred operation point. The method adjusts the control parameters according to the comparison table for ensuring that the air conditioning system can be operated with the minimum power consumption.

4 Claims, 5 Drawing Sheets

AIR CONDITIONING SYSTEM AND CONTROL PARAMETERS ADJUSTMENT METHOD

BACKGROUND OF THE INVENTION

1. Field of the Invention

The present invention relates to an air conditioning system and a control parameters adjustment method of the air conditioning system, and more particular relates to a control parameters adjustment method for decreasing power consumption of the air conditioning system.

2. Description of the Related Art

An air conditioning system is adapted for ventilating an indoor space or adjusting temperature of the indoor space. A conventional air conditioning system comprises a plurality of units such as a compressor, a condenser fan, and a blower, which are all operated according to control parameters. Each unit has different influences to the temperature. Therefore, adjusting control parameters of the units is an important issue of the air conditioning system.

The conventional air conditioning system stores a table. The table includes a relationship between the control parameters of the units and output powers of the air conditioning system. In a laboratory, the units are tested by different control parameters, and output powers corresponding to the different control parameters are recorded for building up the table. When a user selects a particular output power, the conventional air conditioning system loads the control parameters corresponding to the selected output power from the table. Then, the conventional air conditioning system uses the loaded control parameters for generating the particular output power.

The table does not include a relationship between the control parameters and power consumption of the air conditioning system. When the conventional air conditioning system is applied to a device such as an electric vehicle that is operated under a constant sum of electric energy, the power consumption of the electric vehicle needs to be considered carefully. Otherwise, the electric vehicle will run out of electric energy quickly. The power consumption of the air conditioning system is also an important issue.

SUMMARY OF THE INVENTION

An objective of the present invention is to provide an air conditioning system and a control parameters adjustment method of the air conditioning system. When the air conditioning system is operated at a particular output power, control parameters of the air conditioning system can be optimized to ensure that the power consumption of the air conditioning system is minimum. The power consumption can be reduced by the air conditioning system.

To achieve the foregoing objective, the control parameters adjustment method of the air conditioning system including a plurality of units comprises the following steps:

building up a consumption comparison table, wherein the comparison table comprises control parameters of the units, power consumption and output power of the air conditioning system;

determining an objective output power of the air conditioning system;

determining whether there is only one preferred operation point corresponding to the objective output power by searching the comparison table;

wherein the preferred operation point indicates the control parameters by which the power consumption under the determined objective output power is minimum;

when there is only one preferred operation point, adjusting the control parameters of each unit based on the only one preferred operation point; and when there are a plurality of preferred operation points, executing a retrieval procedure for selecting one of the preferred operation points, and adjusting the control parameters of each unit based on the selected preferred operation point.

Furthermore, to achieve the foregoing objective, the air conditioning system comprises the units including a compressor, a blower, a condenser fan, and a controller electronically connected with the compressor, the blower, and the condenser fan. The controller controls control parameters of each unit of the air conditioning system. The control parameters of the units are rotational speed of the units or the duty cycle of the units.

The controller comprises a storage unit and a processing unit. The storage unit stores a comparison table. The comparison table includes control parameters of each unit, power consumption, and output power of the air conditioning system.

The processing unit determines an objective output power of the air conditioning system, and determines whether there is only one preferred operation point corresponding to the objective output power by searching the comparison table.

The preferred operation point indicates the control parameters by which the power consumption under the determined objective output power is minimum.

When there is only one preferred operation point corresponding to the objective output power, the processing unit adjusts the control parameters of each unit based on the preferred operation point. When there are a plurality of preferred operation points corresponding to the objective output power, the processing unit further executes a retrieval procedure for selecting a preferred operation point, and adjusts the control parameters of each unit based on the selected preferred operation point.

The method adjusts the control parameters of the units according to the comparison table. Then, the air conditioning system can be operated under the minimum power consumption.

When there are a plurality of preferred operation points at the objective output power, the retrieval procedure can be executed for selecting one of the preferred operation points.

Other objectives, advantages and novel features of the invention will become more apparent from the following detailed description when taken in conjunction with the accompanying drawings.

DETAILED DESCRIPTION OF THE INVENTION

Figure 1:
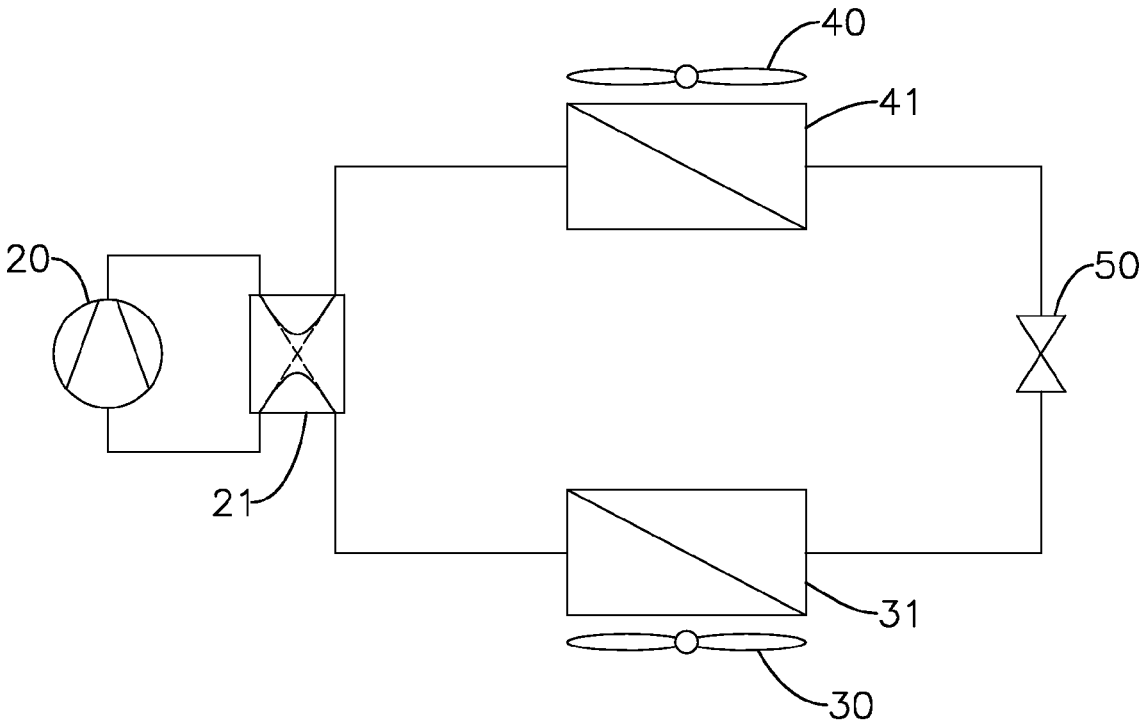
FIG. 1 is a schematic diagram of an embodiment of an air conditioning system of the present invention.
Figure 2:
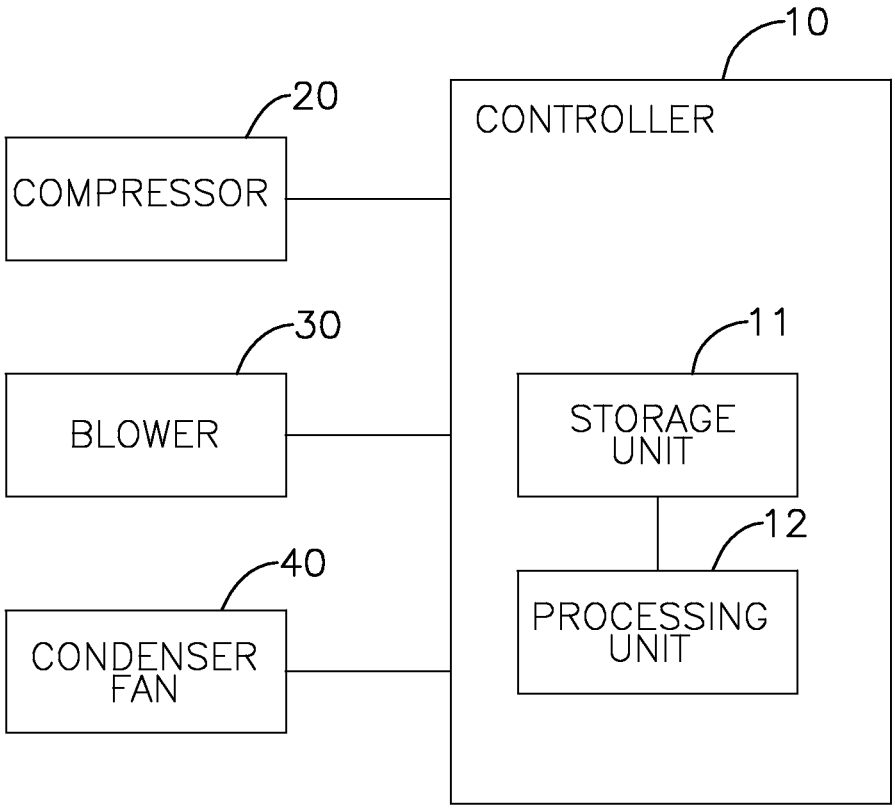
FIG. 2 is a block diagram of the air conditioning system of FIG. 1.

With reference to FIG. 1 and FIG. 2, the present invention is an air conditioning system. The air conditioning system comprises multiple units including a controller 10, a compressor 20, a four-way switching valve 21, a blower 30, an evaporator 31, a condenser fan 40, a condenser 41, and an expansion valve 50. The compressor 20, the blower 30, and the condenser fan 40 are operated according to their respective control parameters. As an example, the control parameters of each unit include rotational speed and the duty cycle.

The controller 10 is electronically connected with the compressor 20, the blower 30, and the condenser fan 40, and comprises a storage unit 11 and a processing unit 12. The storage unit 11 stores a comparison table. The comparison table includes control parameters of each unit, output power, and power consumption of the air conditioning system. The processing unit 12 determines an objective output power, and determines whether there is only one preferred operation point corresponding to the objective output power by searching the comparison table. The preferred operation point means the optimum control parameters by which the power consumption under the determined objective output power is minimum. However, there may be a plurality of preferred operation points all corresponding to the minimum power consumption under the same determined objective output power.

Therefore, when there is only one preferred operation point corresponding to the objective output power, the processing unit 12 adjusts the control parameters of each unit based on the preferred operation point. When there are a plurality of preferred operation points corresponding to the same objective output power, the processing unit 12 further executes a retrieval procedure for selecting one of the preferred operation points, and adjusts the control parameters of each unit based on the selected preferred operation point. The objective output power of the air conditioning system is selected by a user, and the objective output power may be different from a output power.

In the embodiment, the comparison table records different control parameters of each unit of the air conditioning system, and different output powers and power consumptions of the air conditioning system corresponding to the different control parameters. For example, the rotation speed of the compressor 20 is 1000 rpm, the duty cycle of the blower 30 is 20%, and the duty cycle of the condenser fan 40 is 30%. The output power of the air conditioning system corresponding to the foregoing control parameters is 900 w and the power consumption is 1000 w.

The comparison table is built up by testing the units of the air conditioning system operated under different control parameters, and then recording the output powers and the power consumptions of the air conditioning system corresponding to the different control parameters. Therefore, the minimum power consumption at the objective output power can be obtained according to the consumption comparison table.

When the processing unit 12 executes the retrieval procedure, the processing unit 12 firstly selects one of the units and only adjusts the control parameter of the selected unit while control parameters of other units not being selected are maintained unchanged for adjusting the output power to be the objective output power. When adjusting the control parameter of the selected unit, the processing unit 12 calculates a sensitive coefficient of the selected unit. The sensitive coefficient is calculated by firstly calculating a difference between the control parameter of the selected unit corresponding to the output power and the control parameter of the selected unit corresponding to the objective output power, and then dividing the difference by the control parameter of the selected unit corresponding to the output power. If the output power cannot be adjusted to the objective output power by changing the control parameter of the selected units, the sensitive coefficient of the selected unit is recorded as infinity.

The sensitive coefficient is calculated by $$\frac{P_{objective} - P_{current}}{P_{current}}.$$

$P_{current}$ is the control parameter of the selected unit corresponding to the output power, and $P_{objective}$ is the control parameter of the selected unit corresponding to the objective output power.

The processing unit 12 then continues to calculate the sensitive coefficient of another unit until all the sensitive coefficients have been calculated.

For example, the rotational speed of the compressor 20 is 1000 rpm, the duty cycle of the blower 30 is 20%, and the duty cycle of the condenser fan 40 is 30%, which are corresponding to the output power. When the rotational speed of the compressor 20 is adjusted to 1100 rpm and the duty cycles of the blower 30 and the condenser fan are maintained at 20% and 30%, the output power of the air conditioning system can be adjusted to the objective output power. The sensitive coefficient of the compressor 20 is $$\frac{1100 - 1000}{1000} \times 100\% = 10\%.$$

The processing unit 12 further calculates the sensitive coefficients of the blower 30 and the condenser fan 40. The sensitive coefficient of the blower 30 is $$\frac{40 - 20}{20} \times 100\% = 100\%,$$

and the sensitive coefficient of the condenser fan 40 is $$\frac{50 - 30}{30} \times 100\% = 66.7\%.$$

When all the sensitive coefficients of the units are calculated, the processing unit 12 further selects one of the preferred operation points and one of the units, and calculates a variation percentage of the control parameter of the selected unit. The variation percentage of the selected unit is calculated by $$\frac{P_{preferred} - P_{current}}{P_{current}}$$

$P_{current}$ is the control parameter of the selected unit corresponding to the output power, and the $P_{preferred}$ is the control parameter of the selected unit corresponding to the selected preferred operation point.

Then, the processing unit 12 calculates a variation of the selected unit by means of dividing the variation percentage of the selected unit by the sensitive coefficient of the selected unit.

The variation of the selected unit is calculated by $$\frac{P_{preferred} - P_{current}}{P_{current}} \times \frac{1}{\text{sensitive coefficient}}.$$

The processing unit 12 then continues to calculate the variation of another unit of the selected preferred operation point until all the variations corresponding to the selected preferred operation point have been calculated.

The processing unit 12 further calculates a unit variation of the selected preferred operation point by summing up the variations of the units.

Furthermore, the processing unit 12 repeatedly selects another one of the preferred operation points, and calculates its unit variations until all the unit variations of the preferred operation points are obtained, and selects the preferred operation point with the minimum unit variation.

The output power and the objective output power will be changed. Therefore, the sensitive coefficient needs to be calculated again when the output power or the objective output power is different.

The retrieval procedure can select a preferred operation point for stabilizing the air conditioning when the control parameters of the units of the air conditioning system are changing.

Furthermore, the air conditioning system of the present invention can predetermine whether there is only one preferred operation point at each objective operation point based on the comparison table. When a plurality of preferred operation points at an objective output power is predetermined, the processing unit 12 can execute the retrieval procedure for preselecting one of the preferred operation points corresponding to the objective operation point before the air conditioning system is operating. Then the processing unit 12 records the selected preferred operation point in the comparison table. Therefore, only one preferred operation point corresponding to the objective output power can be determined based on the comparison table.

For example, the control parameters of the units corresponding to the output power are (1000, 20, 30). (1000, 20, 30) indicates that the rotation speed of the compressor 20 is 1000 rpm, the duty cycle of the blower 30 is 20%, and the duty cycle of the condenser fan 40 is 30%. The sensitive coefficient of the compressor 20 is 10%, the sensitive coefficient of the blower 30 is 100%, and the sensitive coefficient of the condenser fan 40 is 66.7%. The preferred operation points corresponding to the objective output power are (1200, 60, 50) and (1500, 30, 40). The unit variations of each preferred operation point are:

$$\left(\frac{1200-1000}{1000} \times \frac{1}{10\%}\right) + \left(\frac{60-20}{20} \times \frac{1}{100\%}\right) + \left(\frac{50-30}{30} \times \frac{1}{66.7\%}\right) = 4.99;$$

$$\left(\frac{1500-1000}{1000} \times \frac{1}{10\%}\right) + \left(\frac{30-20}{20} \times \frac{1}{100\%}\right) + \left(\frac{40-30}{30} \times \frac{1}{66.7\%}\right) = 5.99;$$

The unit variation of the preferred operation point, (1200, 60, 50), is less than the preferred operation point, (1500, 30, 40). Then the preferred operation point with the minimum unit variation, (1200, 60, 50), is selected according to the retrieval procedure for stabilizing the air conditioning system.

Figure 3:
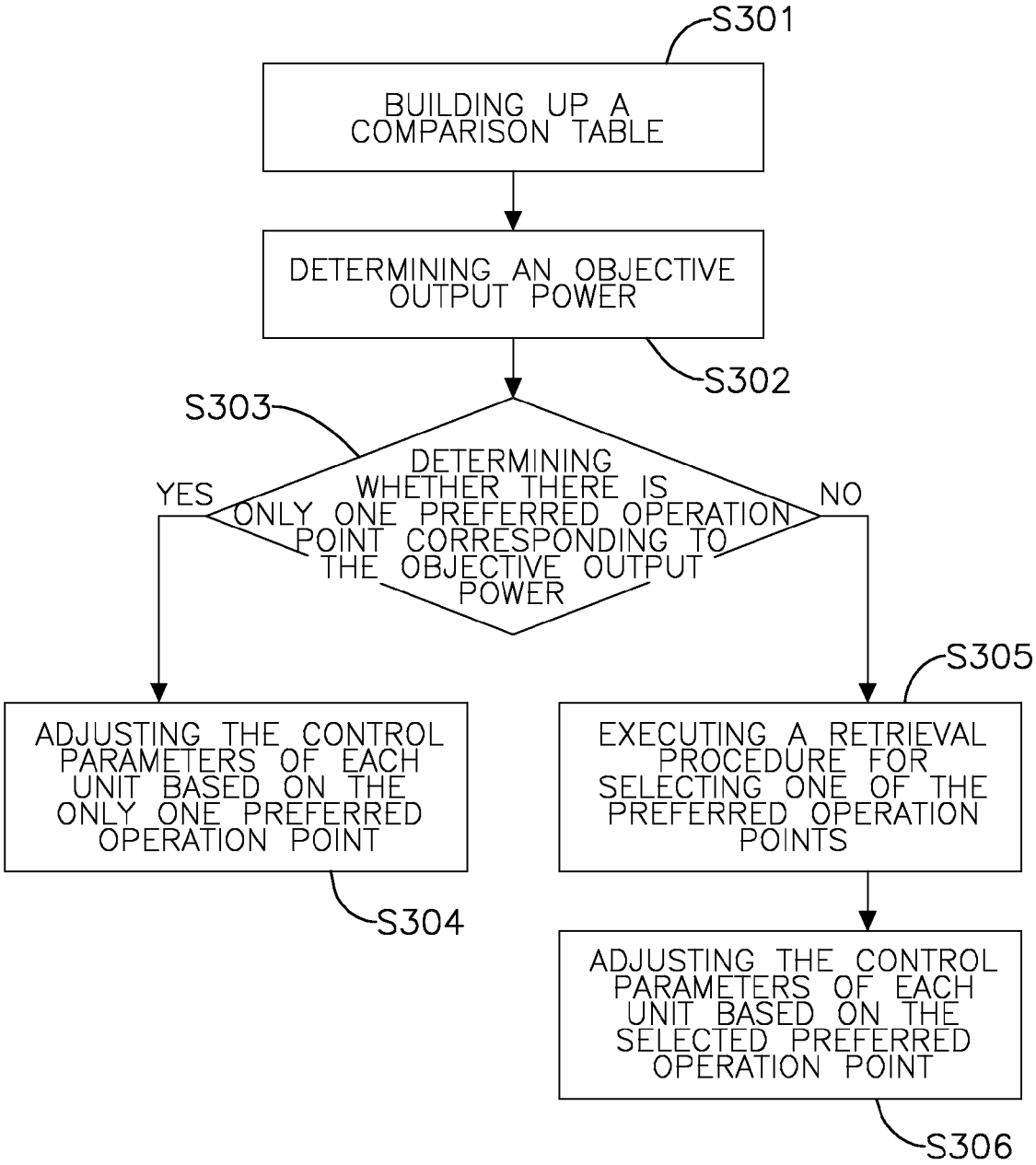
FIG. 3 is a flow chart of a control parameters adjustment method of the present invention.

In another aspect, with reference to FIG. 3, the present invention further comprises a control parameters adjustment method of the air conditioning system. The adjustment method comprises the following steps:

building up a comparison table, wherein the comparison table comprises control parameters of the units, power consumption and output power of an air conditioning system (S301);

determining an objective output power of the air conditioning system (S302);

determining whether there is only one preferred operation point corresponding to the objective output power by searching the comparison table (S303);

when there is only one preferred operation point, adjusting the control parameters of each unit based on the only one preferred operation point (S304); and when there are a plurality of preferred operation points, executing a retrieval procedure for selecting one of the preferred operation points (S305), and adjusting the control parameters of each unit based on the selected preferred operation point (S306).

Figure 4A:
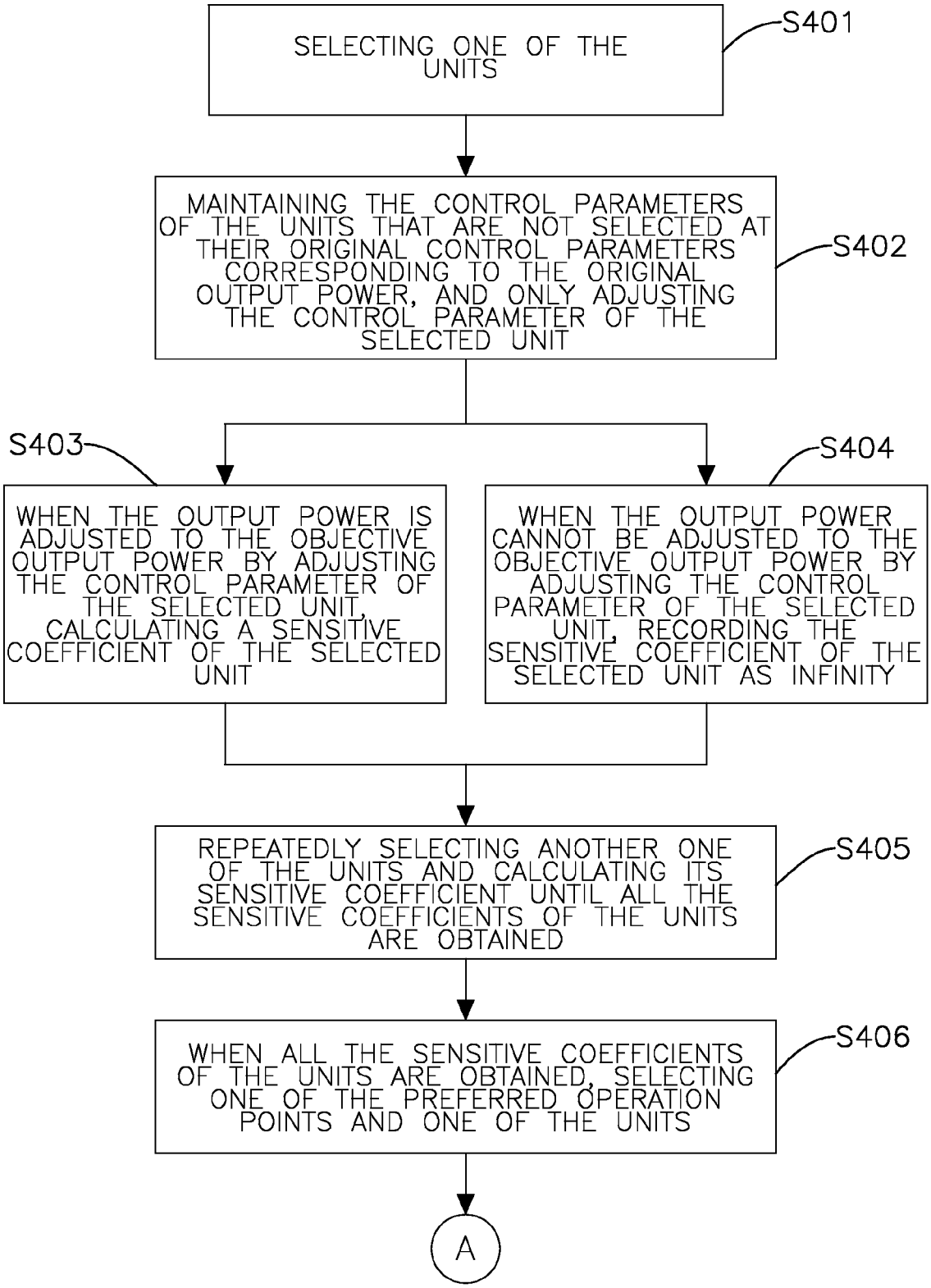
FIGS. 4A and 4B are flow charts of a retrieval procedure of the adjustment method of FIG. 3.
Figure 4B:
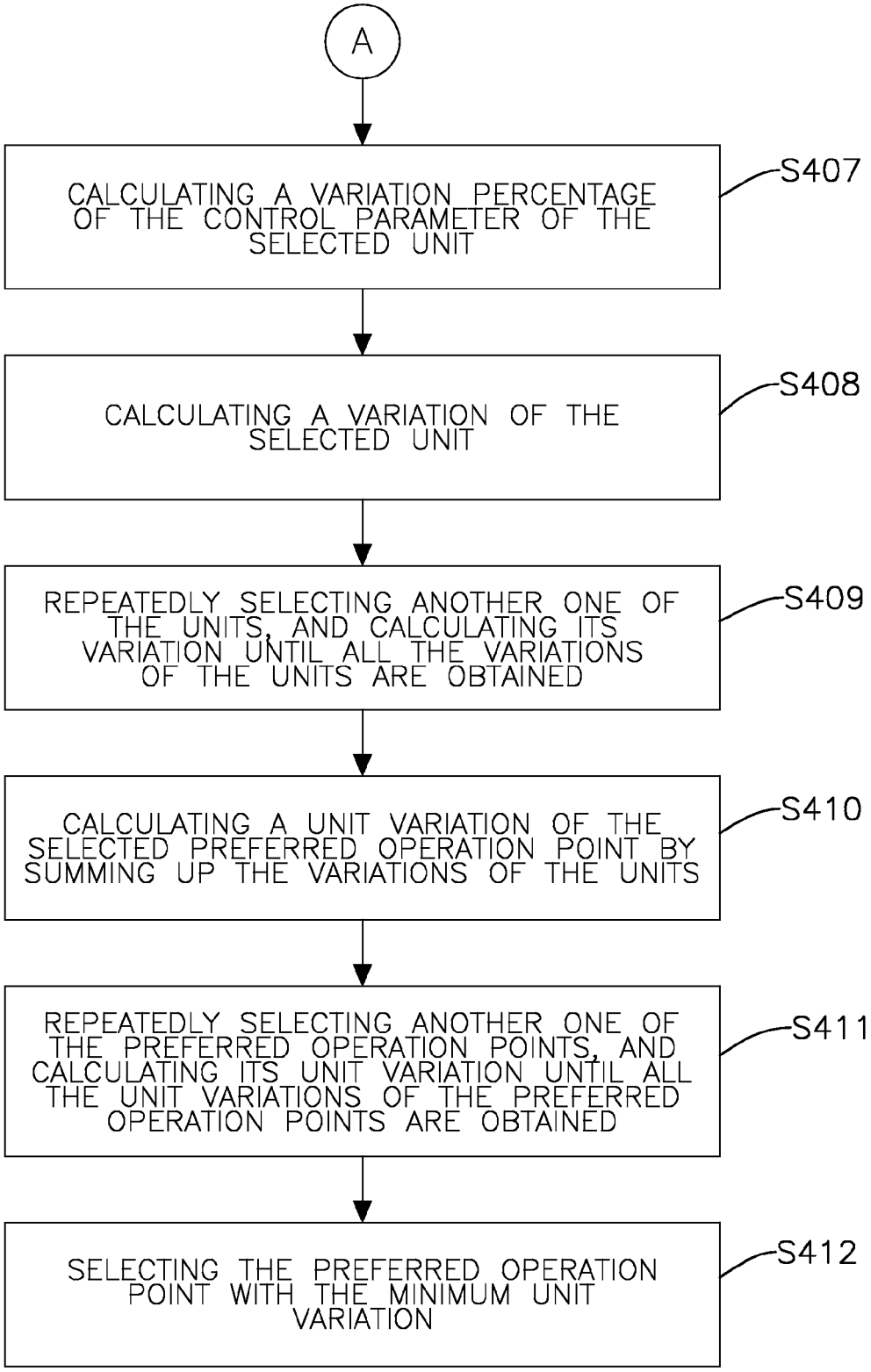

With reference to FIGS. 4A and 4B, the retrieval procedure comprises the following steps:

selecting one of the units of the air conditioning system (S401);

maintaining the control parameters of the units that are not selected at their original control parameters corresponding to the original output power, and only adjusting the control parameter of the selected unit (S402);

when the output power is adjusted to the objective output power by adjusting the control parameter of the selected unit, calculating a sensitive coefficient of the selected unit (S403);

when the output power cannot be adjusted to the objective output power by adjusting the control parameter of the selected unit, recording the sensitive coefficient of the selected unit as infinity (S404);

repeatedly selecting another one of the units and calculating its sensitive coefficient until all the sensitive coefficients of the units are obtained (S405);

when all the sensitive coefficients of the units are obtained, selecting one of the preferred operation points and one of the units (S406);

calculating a variation percentage of the control parameter of the selected unit (S407);

calculating a variation of the selected unit (S408);

repeatedly selecting another one of the units, and calculating its variation until all the variations of the units are obtained (S409);

calculating a unit variation of the selected preferred operation point by summing up the variations of the units (S410);

repeatedly selecting another one of the preferred operation points, and calculating its unit variation until all the unit variations of the preferred operation points are obtained (S411); and selecting the preferred operation point with the minimum unit variation (S412).

The method selects the preferred operation point based on the consumption table. Therefore the air conditioning system can be operated at the minimum power consumption for reducing electronic power consumption of the air conditioning system. When there are a plurality of preferred operation points corresponding to the objective output power, the method can select a preferred operation point according to the retrieval procedure for stabilizing the units of the air conditioning system.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A control parameters adjustment method of an air conditioning system including a plurality of units, the method comprising the following steps:

building up a comparison table, wherein the comparison table comprises control parameters of the units, power consumption and output power of the air conditioning system;

determining an objective output power of the air conditioning system;

determining whether there is only one preferred operation point corresponding to the objective output power by searching the comparison table, wherein the preferred operation point indicates the control parameters by which the power consumption under the determined objective output power is minimum;

when there is only one preferred operation point, adjusting the control parameters of each unit based on the only one preferred operation point; and when there are a plurality of preferred operation points, executing a retrieval procedure for selecting one of the preferred operation points, and adjusting the control parameters of each unit based on the selected preferred operation point;

wherein the retrieval procedure comprises the following steps:

selecting one of the units of the air conditioning system;

maintaining the control parameters of the units that are not selected at their original control parameters corresponding to the original output power, and only adjusting the control parameter of the selected unit;

when the output power is adjusted to the objective output power by adjusting the control parameter of the selected unit, calculating a sensitive coefficient of the selected unit;

wherein the sensitive coefficient is calculated by $$\frac{P_{objective} - P_{current}}{P_{current}}$$

wherein $P_{current}$ is the control parameter of the selected unit corresponding to the output power, and $P_{objective}$ is the control parameter of the selected unit corresponding to the objective output power;

repeatedly selecting another one of the units and calculating its sensitive coefficient until all the sensitive coefficients of the units are obtained; when all the sensitive coefficients of the units are obtained, selecting one of the preferred operation points and one of the units;

calculating a variation percentage of the control parameter of the selected unit;

wherein the variation percentage of the selected unit is calculated by $$\frac{P_{preferred} - P_{current}}{P_{current}};$$

wherein $P_{current}$ is the control parameter of the selected unit corresponding to the output power, and $P_{preferred}$ is the control parameter of the selected unit corresponding to the selected preferred operation point;

calculating a variation of the selected unit;

wherein the variation is calculated by $$\frac{P_{preferred} - P_{current}}{P_{current}} \times \frac{1}{\text{sensitive coefficient}};$$

repeatedly selecting another one of the units and calculating its variation until all the variations of the units are obtained;

calculating a unit variation of the selected preferred operation point by summing up the variations of the units;

repeatedly selecting another one of the preferred operation points and calculating its unit variation until all the unit variations of the preferred operation points are obtained; and selecting the preferred operation point with the minimum unit variation.

2. The adjustment method as claimed in claim 1, wherein the retrieval procedure further comprises: when the output power cannot be adjusted to the objective output power by adjusting the control parameter of the selected unit, recording the sensitive coefficient of the selected unit as infinity.

3. An air conditioning system, comprising multiple units including a compressor, a blower, a condenser fan, and a controller electronically connected with the compressor, the blower and the condenser fan, wherein the controller comprises:

a storage unit configured to store a comparison table, wherein the comparison table includes control parameters of each unit, power consumption, and output power of the air conditioning system;

a processing unit configured to determine an objective output power of the air conditioning system, and determine whether there is only one preferred operation point corresponding to the objective output power by searching the comparison table;

wherein the preferred operation point indicates the control parameters by which the power consumption under the determined objective output power is minimum; and wherein the processing unit further adjusts the control parameters of each unit based on the preferred operation point when there is only one preferred operation point corresponding to the objective output power, or executes a retrieval procedure for selecting a preferred operation point and adjusts the control parameters of each unit based on the selected preferred operation point when there are a plurality of preferred operation points corresponding to the objective output power;

wherein when the processing unit executes the retrieval procedure, the processing unit selects one of the units of the air conditioning system, and maintains the control parameters of the units that are not selected at their original control parameters corresponding to the original output power, and only adjusts the control parameter of the selected unit;

wherein the processing unit further calculates a sensitive coefficient of the selected unit according to the control parameters of the selected unit before and after adjusting when the output power is adjusted to the objective output power by adjusting the control parameter of the selected unit;

wherein the sensitive coefficient is calculated by $$\frac{P_{objective} - P_{current}}{P_{current}}$$

wherein $P_{current}$ is the control parameter of the selected unit corresponding to the output power, and $P_{objective}$ is the control parameter of the selected unit corresponding to the objective output power;

wherein the processing unit further repeatedly selects another one of the units and calculates its sensitive coefficient until all the sensitive coefficients of the units are obtained, and selects one of the preferred operation points and one of the units when all the sensitive coefficients of the units are calculated, and further calculates a variation percentage of the control parameter of the selected unit according to the control parameters corresponding to the output power and the selected preferred operation point;

wherein the variation percentage of the selected unit is calculated by $$\frac{P_{preferred} - P_{current}}{P_{current}};$$

wherein $P_{current}$ is the control parameter of the selected unit corresponding to the output power, and $P_{preferred}$ is the control parameter of the selected unit corresponding to the selected preferred operation point;

wherein the processing unit calculates a variation of the selected unit according to the variation percentage of the selected unit and the sensitive coefficient of the selected unit, and repeatedly selects another one of the units and calculates its variation until all the variations of the units are obtained;

wherein the variation is calculated by $$\frac{P_{preferred} - P_{current}}{P_{current}} \times \frac{1}{\text{sensitive coefficient}};$$

and wherein the processing unit calculates a unit variation of the selected preferred operation point by summing up the variations of the units, and repeatedly selects another one of the preferred operation points and calculates its unit variation until all the unit variations of the preferred operation points are obtained, and further selects the preferred operation point with the minimum unit variation.

4. The air conditioning system as claimed in claim 3, wherein the processing unit records the sensitive coefficient of the selected unit as infinity when the output power cannot be adjusted to the objective output power by adjusting the control parameter of the selected units.

* * * * *